United States Patent [19]

Duncan et al.

[11] Patent Number: 4,852,443

[45] Date of Patent: Aug. 1, 1989

[54] CAPACITIVE PRESSURE-SENSING METHOD AND APPARATUS

[75] Inventors: Donald A. Duncan, Cambridge; Jeffrey B. Tripp, Rockport, both of Mass.

[73] Assignee: Key Concepts, Inc., Woburn, Mass.

[21] Appl. No.: 843,054

[22] Filed: Mar. 24, 1986

[51] Int. Cl.[4] ..... G10H 3/14

[52] U.S. Cl. ..... 84/1.04; 84/1.1; 84/DIG. 12; 200/600; 361/278; 361/283; 361/291

[58] Field of Search ..... 84/1.01, 1.04, 1.06, 84/1.1, 1.24, DIG. 7, DIG. 12; 338/69, 71, 72, 99, 114; 381/111, 113, 116; 361/278, 280, 283, 298, 290, 291; 200/600, DIG. 1; 340/365 C; 341/33

[56] References Cited

U.S. PATENT DOCUMENTS

| | | | |
|---|---|---|---|
| 3,328,653 | 6/1967 | Wolf | 361/283 |
| 3,875,481 | 4/1975 | Miller et al. | 361/283 |
| 3,922,944 | 12/1975 | Kurosaki et al. | 84/477 R |
| 3,956,958 | 5/1976 | Nash et al. | 84/DIG. 7 |
| 4,121,488 | 10/1978 | Akiyama | 84/1.01 |
| 4,176,575 | 12/1979 | Munch | 361/283 |
| 4,213,367 | 7/1980 | Moog | 84/1.1 X |
| 4,320,766 | 3/1982 | Atihanka | 361/283 |
| 4,479,412 | 10/1984 | Klynas | 84/1.04 |
| 4,498,365 | 2/1985 | Tripp et al. | 84/1.24 |
| 4,555,954 | 12/1983 | Kim | 338/99 |
| 4,584,625 | 4/1986 | Kellogg | 361/283 |

*Primary Examiner*—S. J. Witkowski

*Attorney, Agent, or Firm*—Rines and Rines, Shapiro and Shapiro

[57] ABSTRACT

A novel capacitive pressure-sensitive sensing technique and apparatus wherein an elastomeric conductive electrode carrying a two-dimensional array of projections is pressure-deformed against a fixed coextensive cooperative electrode to generate signals, such as tones and sounds in the application to musical instruments, or visual representations, corresponding to the dynamic pressures applied over the two-dimensional surface. A novel drum-like and other musical instruments embodying such novel capacitive sensing techniques and the like are described.

42 Claims, 5 Drawing Sheets

CAPACITIVE PRESSURE-SENSING METHOD AND APPARATUS

The present invention relates to pressure-sensing methods and apparatus, being more specifically concerned with novel two-dimensional capacitive sensors and techniques particularly, though by no means exclusively, applicable to musical and rhythmic instruments and other devices responsive to touch and variable forces applied over a two-dimensional surface.

Novel capacitive pressure sensors having a resilient shaped, curved, or tapered conductive electrode that is deformed by an instrument key activation or other pressure into engaging variable capacitive cooperation with a fixed electrode electrically separated therefrom are disclosed in U.S. Pat. No. 4,498,365, of applicant Jeffery Tripp herein, and are most useful for operation by a single limited region of pressure contact. Such sensors provide continuous sensing, as for electronic tone generation in an instrument, and even enable further pressure variations after the key activation or other pressure contact, as for such purposes as enabling a second note generation or pitch or tone variation, in the illustration of usage in an instrument keyboard. Clearly other applications requiring similar response are also useful.

There are occasions, however, where it is desired to enable pressure to be applied over a two-dimensional surface and with sensitivity to variations in attack or impact and/or response to particular patterns or dynamic shape variations of the pressure over the two-dimensional surface. As an illustration, consider a drum membrane to be activated by the impact of a drum stick, the sweeping of a drum brush, and/or the sweeping of fingers or the hand with various dynamic pressure patterns and variations over the membrane. Such a membrane requires two-dimensional independent fine-point or region pressure sensing and transducing into electrical signals for the purpose of generating sounds that characterize the pressures and pressure patterns. Similarly, as another illustration, configurations may be designed with multiple electrodes cooperating with a common elastomeric electrode, later described, for the reproducing of visual patterns, as for measuring hand, finger or foot prints and variations in movement thereof, again operating with two-dimensional continuous, dynamic sensing.

For use in tactile sensors to develop sensory feedback, compliant conductive elastomer pads have been developed with an array of tactiles which are voltage excited and operate by resistance changes in response to pressure and are scanned in a row-column sequence to provide a multi-bit digital signal output for such purposes. (See, for example, Barry Wright Corporation 1984 bulletin "Sensorflex/Astek", p. 17, 18). Such sensors, while two-dimensional, have problems in stability of conductivity over time, require complex electronics, and have practical limits on the size or area that can be monitored in view of the pad resistance involved.

An object of the present invention, accordingly, is to provide a new and improved method of and apparatus for providing such two-dimensional pressure-sensing responses for such applications and others requiring similar responses.

A further object is to provide novel musical and rhythmic instruments of great flexibility, including drum-like instruments, resulting from the use of the novel pressure sensing of the invention.

Other and further objects will be explained hereinafter and will be more particularly delineated in the appended claims.

In summary, however, from one of its aspects, the invention embraces a capacitive pressure-sensitive sensor having, in combination, a first electrode comprising a thin resilient conductive plastic sheet having a plurality of closely spaced resilient conductive projections protruding from one surface of the sheet and with adjacent regions pressure-deformable by application of pressure thereat from the opposite surface of the sheet, and a second electrode facing and coextensive with the projections and separated from the same by a thin dielectric layer therebetween. Preferred and best mode embodiments and components, including drum instruments and the like, are hereinafter described in detail.

The invention will now be described with reference to the accompanying drawings, FIG. 1 of which is a transverse section of a preferred two-dimensional capacitive pressure sensor useful for the practice of the invention;

Figure 1:
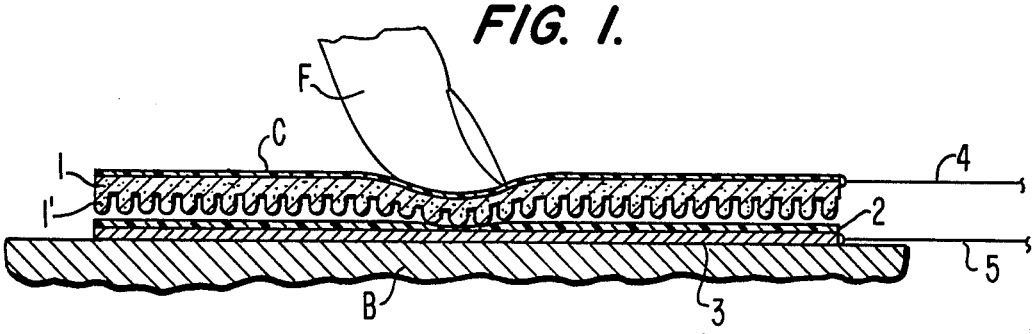

Referring to FIG. 1, the pressure sensor, in preferred form, comprises a thin plastic conductive rubber or other resilient elastomeric pad electrode 1, preferably provided with a protective cover layer C, as of Mylar or the like as later more fully discussed, and having a planar surface from one side of which (shown as the bottom surface) curved or otherwise variable thickness or tapered projections 1' of the same conductive resilient material protrude in a two-dimensional closely spaced preferably uniform array extending in close capacitive relationship with a coextensive two-dimensional conductor electrode surface 3, separated from the projections 1' by a thin dielectric layer 2, preferably somewhat resiliently deformable, also. The electrode surface 3 is shown fixedly disposed on a hard immovable board B, so that pressing of the electrode 1 into mechanical force contact with the immovable electrode 3 develops the desired capacitance changes to be measured, and with the electrode 3 limiting the downward depression of the upper elastomeric pad electrode. In FIGS. 3A–3D, various curved or tapered shapes for the projections 1' are illustrated as substantially hemispherical, as truncated hemispheres with conical or tapered tips, a double conical tip, and a cone with a somewhat rounded tip, respectively.

It has been discovered that when the opposite (upper) surface of the electrode 1 is deformed, as by the finger F in FIG. 1, the curved or tapered projections 1' under the pattern of the finger tip will correspondingly be depressed and deformed, compressing their tapered thickness, with substantially individual independent projection-deforming selectivity, to simulate the finger contour and the various forces exerted by the various portions of the finger tip on the individual projections immediately thereunder. As will be appreciated from FIG. 1 and FIGS. 3A–3D, with the curved or tapered shape of the projections 1', such compression of the projection thickness results in an increasing contact area with the dielectric layer 2 to produce greater capacitive effects. With suitable electronics connected at the output terminals 4 and 5 of this variable capacitor 1-1'-2-3, as later described, the application and movement of the finger tip will generate capacitive variations that are readily processed into signals that may control the generation of audio tones or sounds, with audible effects proportional to the pressure and corresponding to the attack or impact of the finger tip and to surface area dynamic pressure pattern of the moving finger tip on the electrode pad surface 1. With the drum cover layer or head C placed over the silicone rubber or other elastomeric pad electrode 1, protection against abrasion or soiling of the pad and the static attraction of dirt is provided. Additionally, the layer C serves as an electrical insulator and isolator to prevent body capacitance from influencing the system and to prevent introduction of noise. The layer further acts as a "spreader" cover, useful where there may be high local forces (such as the tip of a drumstick) both to limit the compression set of the pad and mechanically to amplify the signal by spreading the impact over a larger area of the capacitor.

Figure 4A:
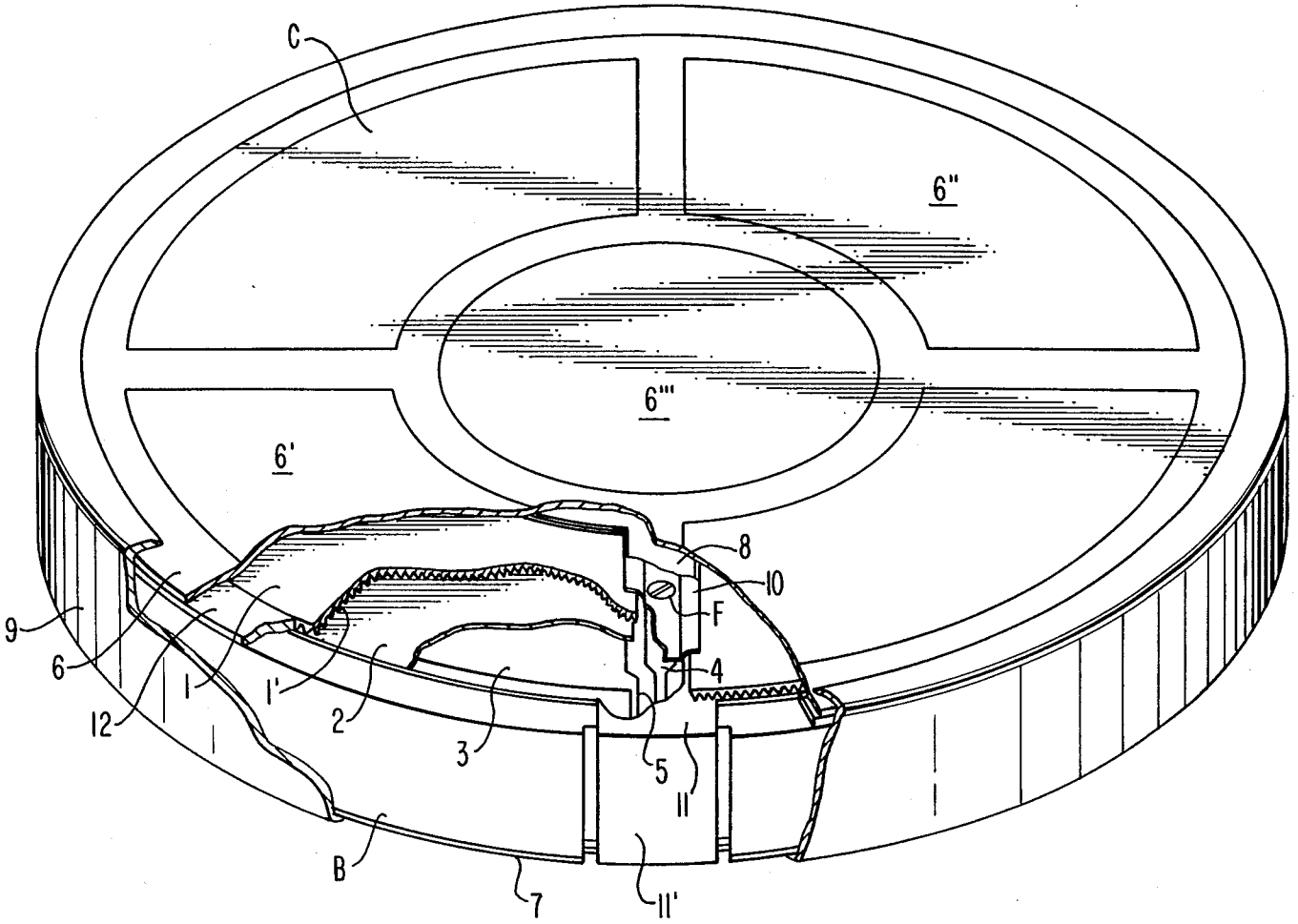
FIG. 4A is an isometric view, partially cut away, of a multi-section drum using effectively a plurality of sensor pads or sensing zones for selective and relatively independent effects.

Referring to the embodiment of FIG. 4A, impacting the drum head membrane or cover layer C with a drum stick, or wire brush, and/or sweeping the stick, brush, fingers, or hands over the membrane, have been found thus to generate individual capacitive variations over the two-dimensional surface that can be signal-processed into sound patterns corresponding to and in substantially proportional response to the pressure patterns applied, and preferably in the continuous pressure-sensing manner of the single sensor units described in the earlier-mentioned patent. Various signal thresholds for degrees of depression can be established as described in said patent, and in connection with FIG. 5, for particular tone or sound effects, including second striking effects during depression and tone variation effects.

Figure 2A:
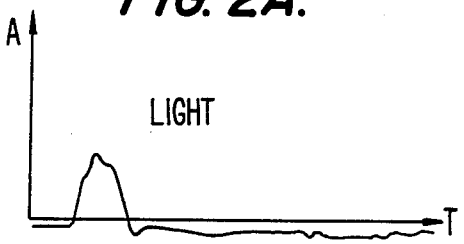
FIGS. 2A–2C are experimentally derived variations obtained by drumstrick impacting of the sensor of FIG. 1, and FIGS. 2D and 2E are outputs for surface pressure-pattern applications thereto.
Figure 2B:
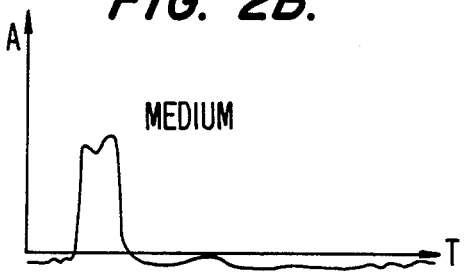
Figure 2C:
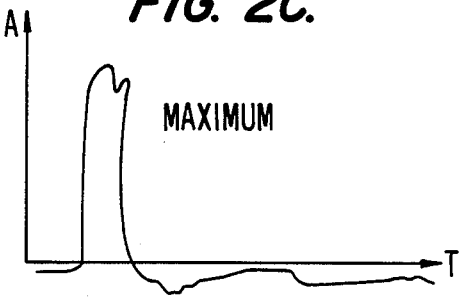

FIGS. 2A–2C show experimentally obtained visual representations of output signals generated by the capacitive changes with this two-dimensional shaped resilient capacitive electrode configuration for light, medium and hard drum stick impacts or strikes of the membrane, displayed on a print-out connected to the electrode, the signal generation being later described in connection with FIG. 5. The electrode 1-1' was of silicone carbon-loaded elastomeric plastic sheeting, about a tenth of an inch thick and of about 60 Durometer, carrying a two-dimensional array of closely spaced shaped projections (100 projections per square inch) protruding about 0.06 inch from a web 1 of about 0.035 inch thickness. The other electrode 3 was of 1 mil aluminum foil with the dielectric layer 2 of "Kapton" (DuPont polyimide plastic), also about 1 mil thick.

Figure 2D:
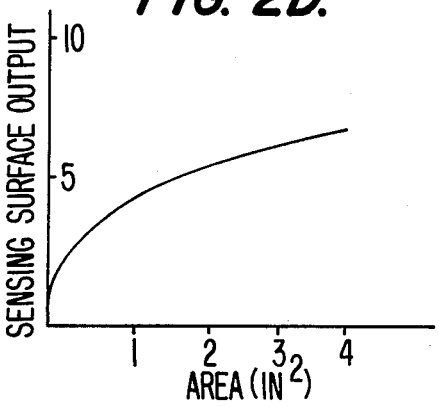
Figure 2E:
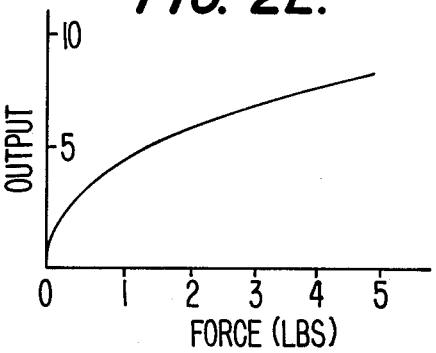
Figure 3A:
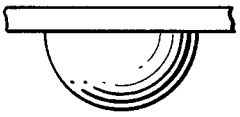
FIGS. 3A–3D are enlarged transverse sectional views of projection configurations useful as electrodes of the sensor of FIG. 1.
Figure 3B:
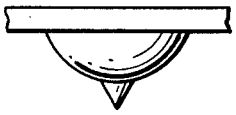
Figure 3C:
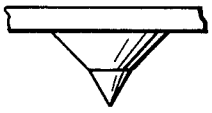
Figure 3D:
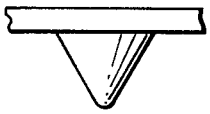

The surface pressure pattern effect is shown in FIGS. 2D and 2E, the former showing the sensing surface output (arbitrary units) in response to area over which the force is applied, and the latter illustrating the output as a function of force applied to the sensing sectors.

Returning to the drum-like application of FIG. 4A, an edge clamp 9 may hold the assembly together and with a dress plate 7 (FIGS. 4A and 4C), which may incorporate a ground plane. If desired, the electronics for the signal processing may be mounted in the underside of the base board B at B', FIG. 4C, as later described.

Separate sectors or regions of the drum head C may be provided as at 6', 6'', etc., FIG. 4A, for different and independent effects at such regions or sectors, and with a formed metallic "spider" separator 10 between regions. The spider separator is bonded to the drum head cover C with an adhesive layer 8 to provide a structure that prevents cross-talk between regions.

The basic system configuration, then, is a P.C. board, (1) for example (screened on a polyester film as of Mylar) which contains the sensing bottom electrode(s) 3, means to connect the drive signal to the elastomer upper electrode(s) 1-1', and means to connect to the main electronics; (2) a sheet of dielectric 2 which may or may not be adhesive-bonded to or screened onto the P.C. board; (3) the upper electrode(s) 1 of textured conductive elastomer as described above; (4) a top cover or drum head C; (5) electronics which provides drive signal to the elastomer electrode(s) 1, supplies the inverse of the drive signal to the other side of the sensing capacitor, monitors for changes in capacitance of the sensor area, and converts such changes to useable electronic signals. There may be multiple electrodes 3 beneath a single elastomeric sheet electrode 1-1', FIG. 4B, to produce a number of independent zones, as well, as later more fully explained.

Total vertical deflection in the system as currently configured is approximately 1/16". The force required to deflect an area is at least roughly proportional to the signal produced, and it "gives back" force in a manner that makes it an effective pressure sensor. The system as described can be modified mechanically and electronically to transduce a wider range of forces and to have a deeper actuation distance for applications for which that would be useful, if desired.

The planar nature of the system means that the smaller the ratio of activation area to total area of the sensing zone, the smaller the activation signal relative to the "base," or resting capacitance of the zone. Since large zones are employed, this base capacitance is large. Further, once the rubber projections 1' are fully depressed, no signal increase results from additional force or pressure. Because of the limited vertical travel, high-velocity small-area strikes "top out" quickly. The use of the semi-rigid Mylar cover C for mechanical amplification brings additional area of the capacitor into play for both light and heavy strikes of small-area implements, producing a broader range of differentiable "attacks". The ratio of the area of neighboring capacitor brought into play versus activating implement area is reduced as the activating implement area gets larger, until an implement as large as the zone shows no amplification effect. In other words, the use of mechanical amplification allows for compressing a broader range of force-area products (pressue or impact) into the narrower range of effective transduction of the sensor/electronics combination.

It is worth noting that the "web" of the conductive rubber electrode 1-1' plays a similar, although not identical, role, with web thickness adjustable to tailor the system for a specific application.

This construction does reduce the degree of independence of local areas of the surface; but it is this which enables the obtaining of comparable signals from a high velocity small area strike (drumstick) and a large area low velocity strike (a finger). The semi-rigid cover of head layer C performs a further dynamic function in the drum. The harder it is hit, the more instantaneously rigid it appears, and the broader the area of the capacitor which is affected (again, mechanical amplification). The cover can vary from nonexistent to thin and elastomeric (protective only), to thin and semi-rigid (thin Mylar), to thicker semi-rigid, to rigid.

The last would be used to make the system area-insensitive for high range low-profile applications such as weighing devices or discrete impact sensors, or in combination with another sensor in a stack to derive area-sensitive information from the top sensor and simultaneous area-insensitive information form the bottom, or in a stack of many sensors for precise force measurement over longer distances.

Figure 4B:
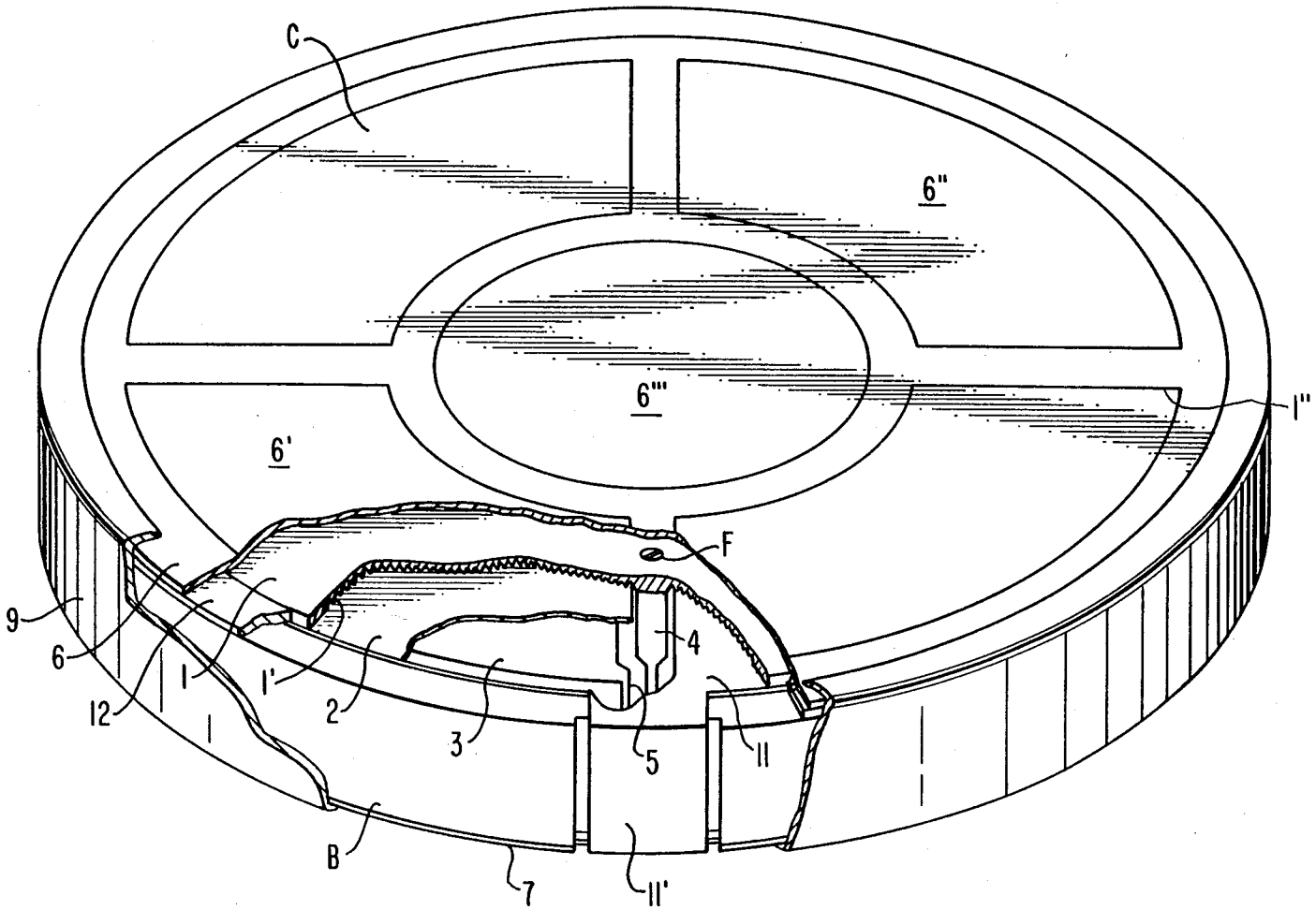
FIG. 4B is similar to FIG. 4A but employs a single elastomeric pad sensor electrode.
Figure 4C:
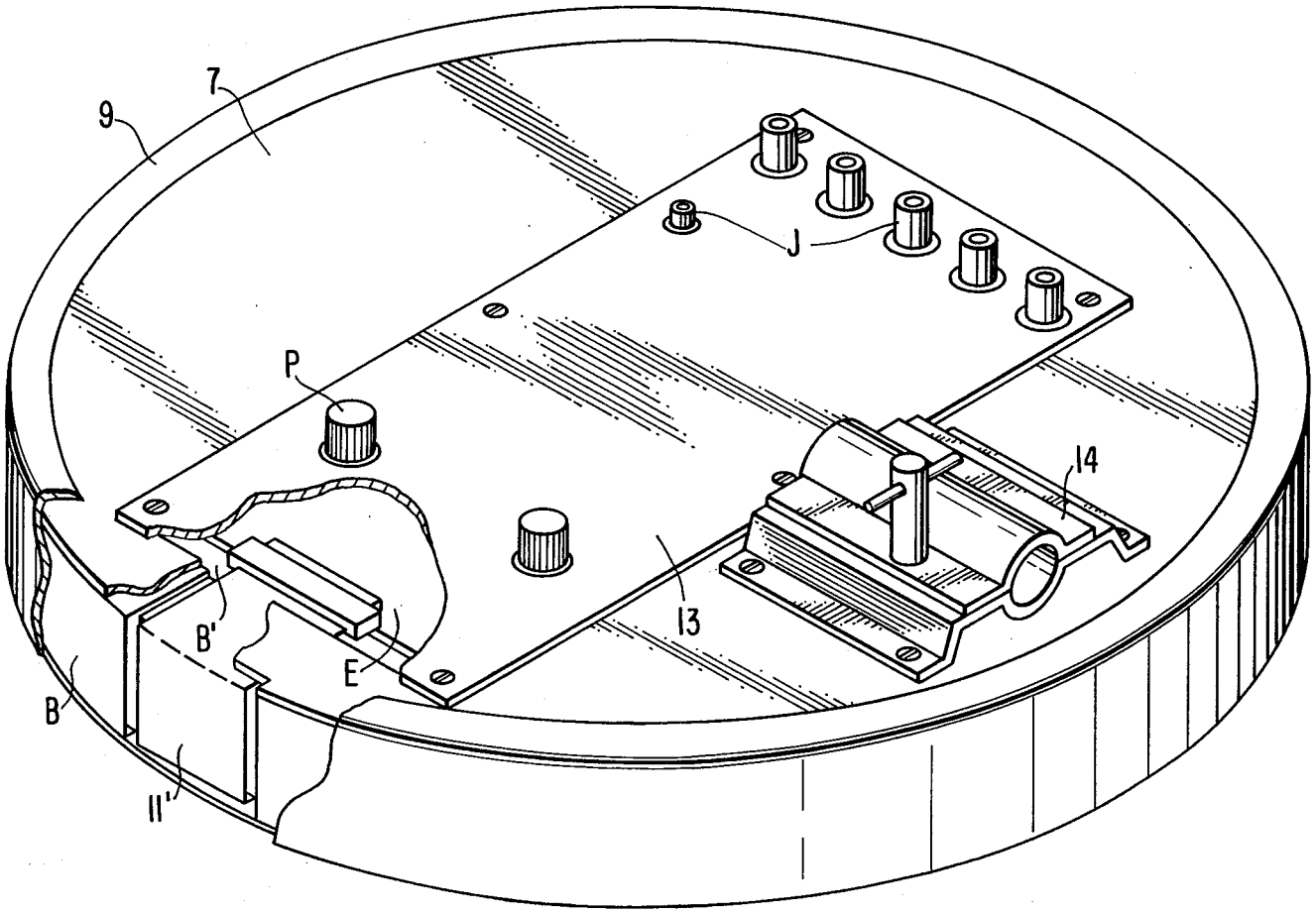
FIG. 4C is a similar view of a bottom section of the drum useful with both of the embodiments of FIGS. 4A and 4B.

The multi-zone or sector electronic drum instrument application of the invention, in its preferred practical configurations, FIGS. 4A and 4B, embodies five independent strike zones 6', 6'', 6''', etc. on its top surface, and five CV (analog Control Voltage) outputs. It is powered by a 12 volt battery or other d.c. power supply and mounts on a standard tom post via a clamp on the bottom, as later explained. The system is responsive to both steady and impulsive forces and with response speed in the tens of microseconds range and a frequency response well into the kilohertz range.

Output is an analog voltage which tracks the changes in capacitance due to striking or pressing the pad; these being scaled to drive most existing CV electronic drum "brains". As before stated, a preferred electronic circuit for operating with the sensors of FIG. 1, 4A and 4B is shown in FIG. 5, using a bottom section, FIG. 4C, common to both the embodiments of FIGS. 4A and 4B. In a practical apparatus, the body of the device is, for example, a 1"-thick particle board disc B which has a cavity B' routed in the back for the electronics. On this is placed a printed circuit sheet 11, as of a die-cut sheet of Mylar, on which is screened a conductive pattern to provide the five bottom electrode surfaces 3 for the five zones 6', 6'', 6''', etc. The drive signal is connected to the elastomeric electrodes 1-1', with conductors 4 and 5 for connection of these areas to the electronics E. The traces travel along a membrane "tail" 11', which wraps around the body to the electronics cavity B'. Over the electrode areas 3 is subsequently screened a urethane-based material which serves as the dielectric layer 2. This layer is also preferably screened on the tail to provide insulation. Upon the printed circuit sheet are placed five die-cut pieces of the elastomeric electrode 1-1' and the spider separator 10. The spider separator is fastened through the printed circuit sheet into the body with several fasteners F, such as screws. This simultaneously positions the electrodes 1-1' in position, and electrically connects the pattern 4 to the five electrodes subsequently to provide the drive signal.

A spacer ring 12 is placed around the periphery of the assembly, with a die-cut adhesive film 8 placed over the spider separator, and the head C is placed onto the assembly, followed by the dress ring 9, which is not yet swaged over on the bottom. The assembly is inverted, the dress plate 7 is installed, and the dress ring is swaged to its final configuration. On an access plate 13 are installed the five output jacks and the power jack J and the two potentiometers P, for all of which, terminals are later identified in the circuit of FIG. 5. These are connected to the electronics E mounted on the bottom B' of the access plate. The membrane tail is then connected to the electronics and the access plate is fastened to the body with the tom clamp 14 fastened in position to complete the assembly.

If the single elastomeric pad version of FIG. 4B is used, the die-cut elastomeric electrodes, the spider, and the adhesive film disappear and are replaced by a single molded pad on which are defined five zones of electrode 1-1' separated by segments of solid conductive rubber 1''. Fasteners are driven through these solid sections, through the printed circuit sheet, and into the body simultaneously to lock the assembly in position and connect the conductor 4 to the electrodes 1-1'.

In the application of the invention to single zone sensors, the invention provides considerable novelty in that it can (1) produce similar signals from similar inputs at different points on the surface, (2) simultaneously transduce the resultant of area and pressure at all points on the surface, and (3) provide continuous output proportional to either static or dynamic pressure patterns on its surface. What it cannot distinguish is (1) the location on its surface of a pressure input, (2) the force being applied at any specified point on its surface, or (3) whether the area-pressure pattern is a large area/low force or a small area/large force. In order to develop this information, it is necessary to use multiple second electrodes, as later described.

Figure 5:
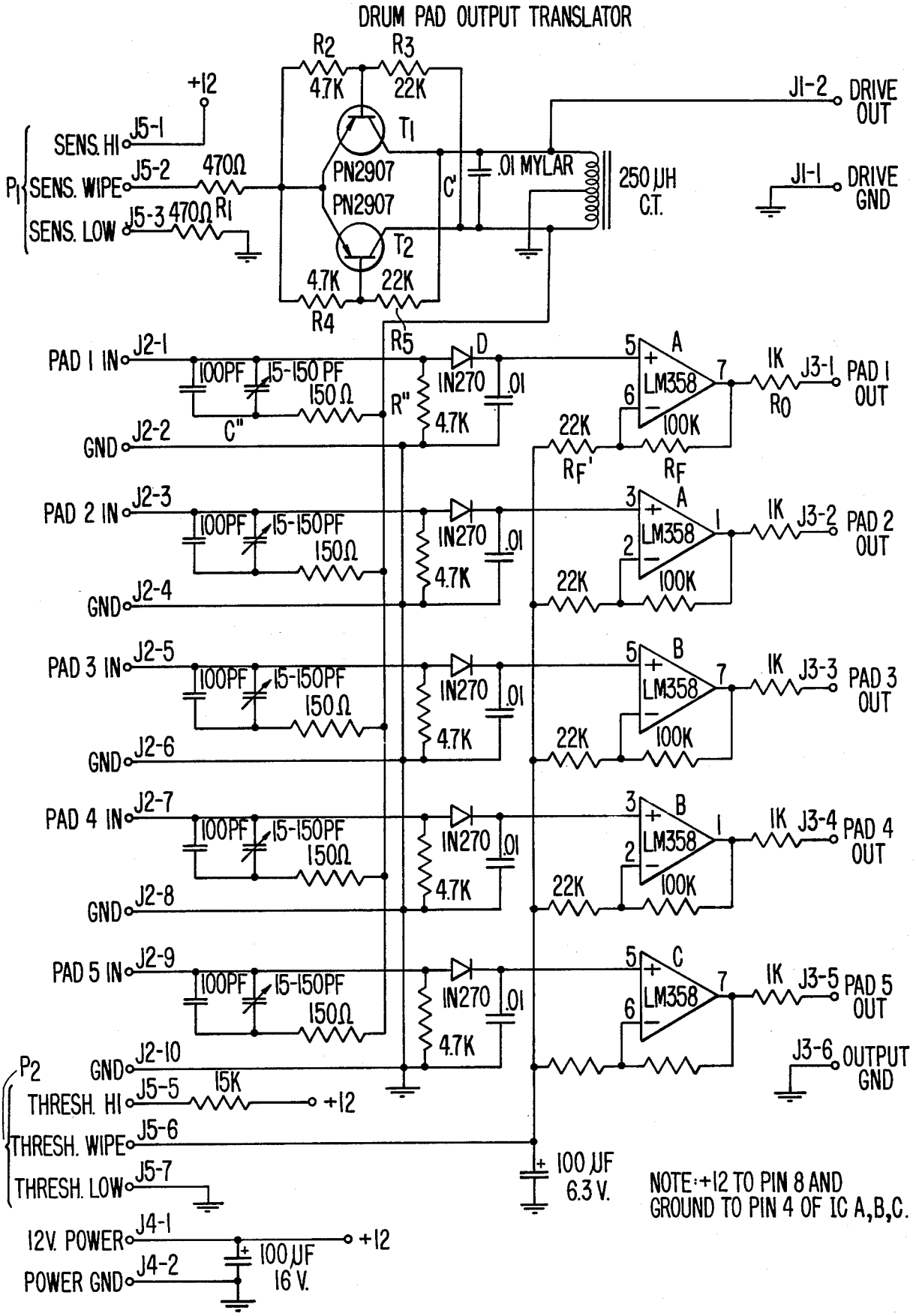
FIG. 5 is a circuit diagram of a preferred signal-processing apparatus for responding to the capacitive variations of the sensors of the instrument of FIGS. 4A and 4B to produce signals that may, for example, be used to control sound generators to generate desired tones and sounds.

Output is an analog voltage which tracks the changes in capacitance due to striking or pressing the pad; these being scaled to drive most existing CV electronic drum "brains." As before stated, a preferred electronic circuit for operating with the sensors of FIGS. 1, 4A and 4B is shown in FIG. 5, using a source of high frequency AC voltage and measuring the degree of AC current flow. The degree of flow is given by the equation: $I=2\ EFC$, where I is the current flow in amperes, E is the applied AC (assumed sine wave) voltage, F is its frequency, and C is the capacitance of the sensor 1-1'-2-3 in Farads. Typical values of these variables in the drum application of the invention are as follows:

$E=8$ volts
$F=100$ KHz
$C=300$ pF
$I=1.0$ mA

Thus the magnitude of current flow represents the instantaneous amount of capacitance which, in turn, reflects the instantaneous product of force and area applied to the sensor. There are several methods for "subtracting out" the "base capacitance" that exists when no force is applied. The preferred method is to apply an equal but 180 degrees out-of-phase voltage through a fixed capacitor equal to the base capacitance and connect the combination to the sensor output. At rest, the two capacitive currents cancel giving zero net current. When pressure increases the current through the sensor, the net current increases away from zero, giving a usable output.

At the top of FIG. 5 a push-pull sine wave power oscillator is shown consisting of two transistors $T_1$, $T_2$, network resistors $R_1$–$R_5$, a center-tapped choke coil CT and a parallel capacitor C'. The combination of the coil CT inductance (250 microhenry) and the capacitance C' (0.01 microfarad) produces a resonant tank circuit with a resonant frequency of approximately 100 KHz. The base-to-collector resistors $R_3$ and $R_5$ (22K ohm) provide feedback necessary to start and sustain oscillation, while the base-to-emitter resistors $R_2$ and $R_4$ (4.7K ohm) limit overdrive on the transistor bases. The series resistor $R_1$ (470 ohms) simulates a current source which improves the oscillator's nearly perfect (approximately 1% distortion) sine wave. Since the center tap of the coil CT is grounded, the ends of the coil provide precisely out-of-phase sine waves of equal amplitude to the remaining circuitry. The oscillator output, labelled "Drive Out" goes to the common plate of the sensors (the conductive rubber pad 1-1' of FIG. 4B, for example) while the opposite oscillator output goes to the signal processing circuitry now to be explained.

The remaining circuitry consists of five similar circuits for the five sensor pads or sensor sectors, the circuit for sensor (pad) #1 (say sector 6', for example,) being illustratively described. The pressure sensor is connected externally between the terminals labelled "Drive Output" and "Pad 1 In". Capacitive current proportional to the sensor's capacitance thus flows into the "Pad 1 In" terminal. At the same time, capacitive current of opposite phase from the opposite side of the oscillator flows into "Pad 1 In" through a series resistance-capacitance network combination in which the resistor value is fixed and the capacitor (C'') value can be varied over a limited range. In practice, the capacitor is adjusted so that its value equals the sensor's base capacitance, as before explained. The resistor effects more complete cancellation of the two currents by accounting for the finite resistance of the conductive rubber pad 1-1'. Perfect balance is achieved only when both C'' and the resistance are matched. In practice, the resistance is only a small portion of the total impedance, so exact resistance match is not overly important (20% resistance mismatch has little effect).

As pressure is applied to the sensor, the net current into the "Pad 1 In" terminal increases away from zero. This current flow develops a small AC voltage across the resistor R'' (4.7K). The AC voltage is rectified by a diode D (1N 270 germanium) and the resulting DC voltage is held on a 0.010 uF capacitor, so labelled. The germanium diode D is used to avoid the threshold effect of silicon diodes due to their relatively high (0.6 volts) forward voltage drop. During times of greater pressure, the positive DC voltage developed across the 0.01 uF capacitor is higher. During times of lesser pressure, the charge of the capacitor leaks away slowly through the diode D over a period of several milliseconds. In this manner, the 0.01 uF capacitor tends to hold the value of pressure peaks momentarily. The relatively small capacitor voltage (generally under a volt) is increased six-fold by an operational amplifier A (LM 358) and feedback network $R_f$ and $R_f'$ (100K and 22K ohms, respectively, for example). The amplifier output voltage is finally applied to the "Pad 1 Out" terminal through a 1K ohm protective resistor $R_o$. This voltage (and those of the other 4 channels) is then routed to a synthesizer which responds in a desirable manner to changes in the voltage level, as is well known.

In actual use, it is desirable to be able to adjust the circuit sensitivity and response to pressure. Overall sensitivity of the sensors is altered by changing the output voltage of the oscillator $T_1$–$T_2$, which is accomplished by changing the oscillator's power supply voltage. This is shown accomplished by externally connecting a potentiometer $P_1$ (1 Kohm) to the "Sens.Hi", "Sens.Wipe", and "Sens.Low" terminals. The 470-ohm resistor connected to "Sens.Low" limits the adjustment to a 3-to-1 range. A threshold effect can also be had by varying the DC voltage at the "Thresh.Wipe" terminal. When this voltage is zero, the final output voltage is a faithful six-times copy of the rectified AC voltage appearing across the 0.010 uF filtered capacitor. As it is made positive, the output voltage (which cannot be negative) will not increase from zero until the recitified voltage increases past a threshold related to the voltage at the "Thresh.Wipe" terminal (bottom left of FIG. 5). This is also accomplished externally by connecting a 1K ohm potentiometer $P_2$ to the three "Thresh." terminals. The 15K resistor connected to "Thresh.Hi" limits the threshold adjustment to a useful range.

Summarizing the operation of FIG. 5, therefore, the oscillator signal (100 KHz) is connected to all the conductive rubber electrodes through "Drive." The amplitude of that "drive" signal is controlled by potentiometer $P_1$ connected to the three terminals "Sens. Hi, Low, and Wipe(r)". The second electrode(s) 3 for each of the five sensing zones is connected to one of five duplicate circuits through the inputs labelled "Pad 1" through "Pad 5." These circuits "measure" the AC capacitive current across each sensor by converting it to an AC voltage across the 4.7K resistor. This AC voltage is converted to a DC voltage by the diode D, then is amplified and sent to the output jacks through the "Pad Out" terminals. Each of these circuits receives the inverse drive signal; each variable capacitor is adjusted until the two drive signals cancel and the capacitive current (and thus the voltage output of each resting system) is as close to zero as possible. The smallest signal which will produce a response may be controlled by adjusting the "Threshhold" potentiometer.

When pressure is applied to a sensor zone, the capacitance is changed, the capacitive current increases, and the DC voltage on the output rises. When the pressure is removed, the output returns to zero. A rapid strike produces a "pulse" with a rapid rise and fall, FIGS. 2A–C, and slow pressure simply produces a proportional slow increase in the voltage of the output. This type of analog output, called CV in the music industry, as before stated, is connected to a sound generator which accepts the CV input, with the level of control of sound depending entirely on the capabilities of the sound generator.

The primary target sound generators are CV electronic drum "brains," and these show different responses based on the characteristics of their input circuitry. If the inputs to the "brain" are AC coupled, for instance, then only sharp strikes (where the DC output simulates AC) will result in sound generation. If, however, the "brain" inputs are DC coupled, any signal which exceeds a particular voltage threshold will produce a sound. It is on these systems that the drum of the invention produces special effects, since, unlike conventional piezoelectric controllers, the system of the invention sustains a voltage proportional to pressure. Maintaining pressure on a pad holds the output voltage above the threshold voltage of the "brain", and continuous sound or repetitive triggering of sounds may occur. If pitch is modified by the voltage amplitude of the input signal, then fluctuation of the pressure on a pad produces corresponding changes of the pitch of the sound.

As before stated, earlier electronic drum controllers (drum pads) use piezoelectric crystals as the transducers. While the transducer of the present invention generates continuous signals relative to an absolute baseline, the piezo transducers generate transient signals proportional to rate of change. They generate a voltage when physically distorted, and the more rapidly and dramatically they are "bent", the higher the voltage generated. However, as soon as the distorting stops, even if they are held in a bent position, they cease to generate a voltage, and the output drops to zero. It is for this reason that they, unlike the present invention, are unable to provide continuing control based on pressure following the intitial strike. Further, since they operate on rate of change, slow distortion does not generate a usable signal. For these reasons, they are especially appropriate as transducers for applications where only a trigger signal is required, and this signal is to be generated by significant impact, but they are not particularly appropriate for keyboard-like controllers when continuing control of sound is desired.

While, therefore, the device of the invention when struck with a drumstick produces an output waveform resembling that produced by conventional electronic drum controllers which use a piezoelectric crystal as a transducer, unlike piezoelectric systems, the system of the invention continues to produce signals proportional to residual pressure, allowing continued control of the sound generating device after the initial strike. Further, it effectively transduces less abrupt dynamic forces which would be inadequate to produce a useful signal from a piezoelectric system.

The controller of the invention also works with synthesizers which produce other than rhythm sounds and are set up to use CV (Control Voltage) inputs. With these, the range of potential effects multiplies, since the voltage of the input may be programmed to control a variety of musical parameters.

The circuit of FIG. 5 is completely analog. To incorporate digital signal processors, each output, either before or after amplification, is put through an ADC (Analog-to-Digital Converter). A microprocessor (or other well-known digital signal processing circuitry) monitors the resulting digital representations of variations of the pad capacitance over time and constructs corresponding digital control signals according to preprogrammed rules of logic (software).

It is also possible to modify the system as described to output digital control signals according to MIDI (Musical Instrument Digital Interface) or other communications protocols. This is accomplished by processing each of the discrete circuit outputs through an ADC to produce digital representations of the variations of sensor capacitance over time. A microprocessor or other digital signal processing circuitry monitors these digital representations and constructs corresponding digital control signals according to pre-programmed rules of logic. Additional control devices (switches, slide potentiometers, displays, etc.) and appropriate hardware and software may be incorporated to allow users to modify the aforementioned pre-programmed rules of logic. Other protocols are possible for communications with computers and robots. Techniques for doing this are well known to those skilled in this art.

Other iterations are also possible including different outer shapes, different modes of construction, different shapes of strike zones, different numbers of strike zones, versions deviating from strictly flat construction, and versions optimized for playing with the hands (e.g., congas) rather than with sticks or mallets.

As another example in the musical instrument field, the "sandwich" electrode 1-1'-2-3 discussed above may be incorporated into a guitar pickguard with two or three small sensitive zones which may be struck or strummed to generate CV signals for control of drum machines or driving MIDI converters. The electronics may be placed in a cavity under the pickguard.

Another iteration of this product allows the use of one or more "roving" pads 1-1'-2-3 which may be placed on the surface of the guitar in a selected location such as under the right arm or on the player's hand or other part of his body with an appropriate fastening mechanism and which uses the installed electronics to perform a function similar to that of the captive pads in the pickguard. Electronics may be modified, furthermore, to produce either MIDI signals or otherwise digitally encoded information which may subsequently be used to control MIDI music devices, guitar effects, stage appliances, etc.

Differently shaped actuation pads 1-1', different numbers of actuation pads, pad locations on other parts of a guitar, and functionally similar systems for mounting independently or on other instruments are also clearly usable.

If it is desired to render the system more insensitive so that absolute pressure or impact is transduced, a rigid layer may be applied above the resilient pad electrode 1-1'. The drum-like instrument, moreover, may function as a keyboard with effects such as those described in the aforesaid patent—holding the signal by holding the pressure on the head and controlling pitch or tone variation by wobbling the pressure, etc.

As before stated, the invention may be also used for other purposes than instruments, including providing visual or picture presentations of pressure variations and patterns as on a printout or cathode ray tube; and it is useful more generally as input sensors for telefactoring, force monitors for purposes such as closing valves and the like, and contact monitors for mobile vehicles, among other applications.

Further modifications will also occur to those skilled in this art, and such are considered to fall within the spirit and scope of the invention as defined in the appended claims.

We claim:

1. Apparatus comprising a capacitive pressure sensitive sensor having, in combination, first electrode means comprising a thin resilient conductive plastic sheet formed with a plurality of permanent, spaced, resiliently deformable, conductive projections protruding from one surface thereof and with adjacent regions pressure-deformable by application of pressure at an opposite surface thereof, and a second electrode means facing and coextensive with the projections and separated from the projections by a thin dielectric layer disposed between the projections and the second electrode means, with the first electrode means, the second electrode means, and the dielectric layer being disposed such that the projections may be resiliently deformed and compressed against the dielectric layer by the application of pressure at the opposite surface of said sheet, and with the projections being shaped such that the area thereof against the dielectric layer, and therefore the capacitance of said sensor, changes in a continuous manner with changes in compression of the projections against the dielectric layer due to changes in pressure at the opposite surface of said sheet.

2. Apparatus as claimed in claim 1 and in which the plurality of projections are disposed in a two-dimensional array of closely spaced projections.

3. Apparatus as claimed in claim 2 and in which the projections, upon deformation, are limited in depression by the presence of the second electrode means which is mounted to be immovable by application of pressure at said opposite surface of said sheet.

4. Apparatus as claimed in claim 3 and in which said projections are substantially uniformly distributed over said array and have curved surfaces facing the second electrode means and deformable when pressed indirectly against said second electrode means with the dielectric layer in between to provide increasing sensor capacitance with increasing pressure at said opposite surface of said sheet.

5. Apparatus as claimed in claim 4 and in which each electrode means of said sensor is connected to electronic means for sensing variations in sensor capacitance with variations in pressure deformation of the first electrode means and for producing signals which vary corresponding to the variations in capacitance.

6. Apparatus as claimed in claim 5 and in which said electronic means produces signals in response to sensor capacitance variations caused by impacts on said opposite surface of the first electrode means.

7. Apparatus as claimed in claim 5 and in which means is provided for converting the produced signals into audio representations of the pressure deformations.

8. Apparatus as claimed in claim 7 and in which the audio representations are tones and sounds generated by drum-like impacting and sweeping contact over the said opposite surface of the first electrode means.

9. Apparatus as claimed in claim 8 and in which the pressure is applied to said opposite surface through a drum head layer mounted thereover.

10. Apparatus as claimed in claim 8 and in which further sensors as aforesaid are provided adjacent to the first-named sensor to produce multi-zone independent drum-like effects.

11. Apparatus as claimed in claim 5 and in which means is provided for converting the produced signals into visual representations of pressure deformation.

12. Apparatus as claimed in claim 2 and in which the projections are of variable thickness such as somewhat tapered.

13. Apparatus as claimed in claim 12 and in which the thickness of said sheet of the first electrode means is of the order of tenths of an inch, the projections are distributed on the order of a hundred per square inch and project on the order of hundredths of an inch, and the second electrode means and dielectric layer are each on the order of mils thick.

14. Apparatus as claimed in claim 1 and in which said second electrode means comprises a plurality of adjacent sector electrodes cooperative with a single common first resilient electrode means.

15. Apparatus as claimed in claim 1 and in which said first resilient electrode means comprises a plurality of separate sector resilient electrodes.

16. Apparatus as claimed in claim 15 and which separator means is disposed between the sector resilient electrodes.

17. Apparatus as claimed in claim 15 and in which a semi-rigid cover layer is disposed over said first resilient electrode means.

18. Apparatus as claimed in claim 14 and in which a semi-rigid cover layer is disposed over said first resilient electrode means.

19. Apparatus as claimed in claim 18 and in which said single resilient electrode means is of conductive elastomeric rubber-like material divided into sectors separated by segments of solid conductive rubber.

20. Apparatus as claimed in claim 16 and in which said first resilient electrode means is of conductive elastomeric rubber-like material.

21. A drum-like instrument having, in combination, a pressure-sensitive capacitive sensor including thin resilient conductive plastic electrode means formed with a plurality of permanent, spaced, resiliently deformable, conductive projections protruding from an inner surface thereof and with adjacent regions pressure-deformable by application of pressure at an outer surface thereof, a semi-rigid drum cover disposed over the outer surface of the resilient electrode means for receiving the pressure and conveying the same to the resilient electrode means, and a second electrode means facing and coextensive with the projections and separated from the projections by a thin dielectric layer disposed between the projections and the second electrode means, with the resilient electrode means, the second electrode means, and the dielectric layer being disposed such that the projections may be resiliently deformed and compressed against the dielectric layer by the pressure applied to the drum cover, and with the projections being shaped such that the area thereof against the dielectric layer, and therefore the capacitance of said sensor, changes in a continuous manner with changes in compression of the projections against the dielectric layer due to changes in pressure applied to the drum cover; and means connected with the first and second electrode means for applying ac voltage or current thereto and sensing changes in capacitance of the sensor with changes in the applied pressure.

22. A drum-like instrument as claimed in claim 21 and in which said projections are arranged in a two-dimensional array.

23. A drum-like instrument as claimed in claim 22 and in which said second electrode means comprises a plurality of adjacent sector electrodes cooperative with said thin resilient electrode means.

24. A drum-like instrument as claimed in claim 23 and in which said thin resilient electrode means comprises a single resilient conductive sheet having said projections formed thereon.

25. A drum-like instrument as claimed in claim 22 and in which said thin resilient electrode means comprises a plurality of separate sector resilient sheet electrodes each having an inner surface formed with a respective two-dimensional array of said projections.

26. A drum-like instrument as claimed in claim 25 and in which means is disposed between the sector resilient sheet electrodes to prevent cross-talk.

27. A drum like instrument having, in combination, sensor means comprising thin resilient conductive elastomeric electrode means having adjacent regions pressure-deformable by application of pressure at the outer surface thereof and formed with a two-dimensional array of permanent, spaced, resiliently deformable projections protruding from an inner surface thereof, a semi-rigid drum cover disposed over the said outer surface for receiving the pressure and conveying the same to the resilient electrode means, and second electrode means facing and coextensive with the resilient electrode means and separated therefrom by a dielectric layer disposed between the resilient electrode means and the second electrode means such that the two said electrode means cannot come into contact with each other, with the resilient electrode means, the second electrode means, and the dielectric layer being disposed such that the projections may be resiliently deformed and compressed against the dielectric layer by the pressure applied to the drum cover, and with the projections being shaped such that the area thereof against the dielectric layer, and therefore the impedence of said sensor means, changes in a continuous manner with changes in compression of the projections against the dielectric layer due to changes in pressure applied to the drum cover; means connected with the two said electrode means for applying voltage or current thereto and sensing the changes in impedance of said sensor means; and means for producing signals corresponding to the sensed changes in impedance and generating sounds in response to said signals corresponding to the pressure applied to said drum cover.

28. A drum-like instrument as clamed in claim 27 and in which said second electrode means comprises a plurality of adjacent sector electrodes cooperative with said thin resilient electrode means.

29. A drum-like instrument as claimed in claim 28 and in which said thin resilient electrode means comprises a single resilient conductive sheet having said projections formed thereon.

30. A drum-like instrument as claimed in claim 27 and in which said thin resilient electrode means comprises a plurality of separate sector resilient sheet electrodes each having an inner surface formed with a respective two-dimensional array of said projections.

31. A drum-like instrument as claimed in claim 30 and in which separator means is disposed between the sector resilient sheet electrodes.

32. A method of capacitive pressure-sensing, that comprises, subjecting adjacent regions of a permanently formed two-dimensional array of spaced, conductive, resiliently deformable plastic projections of tapered thickness to a contour of pressure dynamically applied in a predetermined direction and corresponding to a predetermined pressure pattern extending over one or more regions of the array, limiting movement of the projections in said predetermined direction at a fixed-position, coextensive, cooperative capacitive electrode surface separated from the array by a thin layer of dielectric material disposed between the array and the capacitive electrode surface so that the applied pressure dynamically deforms and compresses the thickness of the projections against the dielectric layer in such a manner that the area of the projections against the dielectric layer varies correspondingly, and sensing resulting dynamic capacitive variations effected by the projections to generate electrical signals corresponding to the capacitive variations.

33. A method as claimed in claim 32 and in which the signals are converted into audio tones and sounds during the deforming.

34. A method as claimed in claim 32 and in which the signals are converted into visual representations during the deforming.

35. Sensor apparatus comprising a pressure-sensitive capacitive sensor including first electrode means having a thin, pressure-deformable resilient conductive plastic sheet formed with a plurality of permanent, spaced, resiliently deformable conductive projections protruding from an inner surface thereof, second electrode means facing and coextensive with said projections, and a layer of dielectric material disposed between said projections and said second electrode means, said projections being depressible for resilient deformation indirectly against said second electrode means with said dielectric layer therebetween in contact with said projections by the application of deforming pressure to an outer surface of said plastic sheet, said projections further being shaped to compressively deform into contact with said dielectric layer over an increasing area with increasing deforming pressure on said outer surface of said plastic sheet such that said sensor exhibits capacitance corresponding to the deforming pressure.

36. Apparatus as claimed in claim 35 and in which said dielectric layer is of a resilient deformable plastic.

37. Apparatus as claimed in claim 35 and in which said projections are arranged in a two-dimensional array.

38. Apparatus as claimed in claim 37 and in which said sensor is incorporated in a drum head, with said outer surface of said plastic sheet being disposed to receive deforming pressure from a drum-playing implement.

39. Apparatus as claimed in claim 38 and including a semi-rigid drum head cover placed over said outer surface of said plastic sheet, said drum head cover transmitting deforming pressure from the drum-playing implement to said outer surface of said plastic sheet.

40. Apparatus as claimed in claim 35 and including means connected to said first and second electrode means for substantially continuously sensing the capacitance of said sensor relative to a base capacitance level and for providing an output signal which corresponds to the sensed capacitance.

41. Apparatus as claimed in claim 40 and in which said output signal is proportional to the sensed capacitance.

42. Apparatus as claimed in claim 40 and including means for converting said output signal into at least one of an audible sound representation of the sensed capacitance and a visual representation of the sensed capacitance.

* * * * *